US006372013B1

(12) United States Patent
Trout et al.

(10) Patent No.: US 6,372,013 B1
(45) Date of Patent: Apr. 16, 2002

(54) CARRIER MATERIAL AND DESULFURIZATION AGENT FOR DESULFURIZING IRON

(75) Inventors: Harry E. Trout, Avon; James M. Wilson, Avon Lake, both of OH (US)

(73) Assignees: Marblehead Lime, Inc.; Wacson, Inc., both of Avon Lake, OH (US)

( * ) Notice: Subject to any disclaimer, the term of this patent is extended or adjusted under 35 U.S.C. 154(b) by 0 days.

(21) Appl. No.: 09/570,109

(22) Filed: May 12, 2000

(51) Int. Cl.[7] ..... C21C 7/064

(52) U.S. Cl. ..... 75/309; 75/315; 75/568; 75/570; 75/535; 75/539

(58) Field of Search ..... 75/309, 315, 568, 75/570, 535, 539

(56) References Cited

U.S. PATENT DOCUMENTS

| | | | | |
|---|---|---|---|---|
| 3,964,899 | A | 6/1976 | Jones et al. | 75/53 |
| 4,142,887 | A | 3/1979 | Luyckx | 75/58 |
| 4,209,325 | A | 6/1980 | Cooper et al. | 75/58 |

(List continued on next page.)

FOREIGN PATENT DOCUMENTS

| | | |
|---|---|---|
| DE | 25 45 340 A | 4/1977 |
| EP | 1 010 765 A1 | 6/2000 |
| GB | 1484258 A | 9/1977 |
| JP | 59-205409 | 11/1984 |
| JP | 1-139714 | 6/1989 |
| JP | 5-222425 | 8/1993 |
| SE | 452024 | 11/1987 |

OTHER PUBLICATIONS

Decreasing Hot Metal Desulfurization Slab Yield Loss, by T.H. Bieniosel and G.E. DeRusha; LTV Steel and L.L. Matanich and R.W. Bartram Airco Carbside, Division of the BOC Group—1988 Steelmaking Conference Proceedings No Month.

The Conservation of Hot Metal During Desulfurization and Skimming Operations by Robert G. Petrushka; LTV Steel Company, Cleveland, No. 1 Steel Producing—1989 Steelmaking Conference Proceedings No Month.

(List continued on next page.)

*Primary Examiner*—Melvyn Andrews
(74) *Attorney, Agent, or Firm*—Armstrong, Westerman & Hattori, LLP

(57) ABSTRACT

A particulate carrier material for use with particulate passivated magnesium for injection into molten iron to desulfurize the iron, improve characteristics of the slag and increase iron yield. Material flow of a transport gas and the carrier material is established in a lance prior to inserting the lance into a ladle-contained molten iron, then following insertion the passivated magnesium is added to the material flow. A second embodiment of the invention for iron desulfurization, blends the carrier material and passivated magnesium into a single desulfurization agent. In both embodiments the particulate magnesium is 14–20 mesh with the remaining particulate material being about 200 mesh. The composition of the carrier material is 54–74% calcium oxide, 19–32% aluminum oxide, no more than 4% magnesium oxide, no more than 10% calcium fluoride, no more than 2.5% silicon dioxide, no more than 1.0% iron oxide, no more than 0.025% phosphorus pentoxide, no more than 0.025% titanium dioxide, no more than 0.5% manganese oxide, no more than 0.025% vanadium pentoxide, no more than 0.025% potassium oxide, no more than 0.05% sulfur and a combined loss on ignition and moisture content of no more than 1.5%. A third embodiment uses carrier material of a narrow range of composition with existing desulfurization processes to improve slag characteristics and increase iron yield.

16 Claims, 4 Drawing Sheets

U.S. PATENT DOCUMENTS

| | | | | |
|---|---|---|---|---|
| 4,217,134 | A | 8/1980 | Russell | 75/58 |
| 4,342,590 | A | 8/1982 | Luyckx | 75/58 |
| 4,374,664 | A | 2/1983 | Mitsuo et al. | 75/58 |
| 4,417,924 | A | 11/1983 | Schwer | 75/257 |
| 4,444,590 | A | 4/1984 | Lee et al. | 75/257 |
| 4,490,173 | A | 12/1984 | Schwar | 75/58 |
| 4,572,737 | A | 2/1986 | Robinson et al. | 75/53 |
| 4,600,434 | A | 7/1986 | Kleimeyer et al. | 75/58 |
| 4,795,491 | A | 1/1989 | Quigley | 75/257 |
| 4,853,034 | A | 8/1989 | Quigley | 75/58 |
| 4,941,914 | A | 7/1990 | Craig et al. | 75/309 |
| 5,021,086 | A | 6/1991 | Luydkx et al. | 75/315 |
| 5,106,412 | A | 4/1992 | Bogan et al. | 75/570 |
| 5,366,539 | A | 11/1994 | Abele et al. | 75/532 |
| 5,397,379 | A | 3/1995 | Barker et al. | 75/319 |
| 5,873,924 | A | 2/1999 | Kinsman et al. | 75/315 |
| 5,972,072 | A | 10/1999 | Kinsman et al. | 75/315 |
| 6,010,658 | A | 1/2000 | Ross et al. | 266/226 |
| 6,179,895 | B1 * | 1/2001 | Barker | 75/323 |

OTHER PUBLICATIONS

Sulfur Control Improvements At the USS—Gary Q–BOP by J. Marsan, D. Blystone, L. Frech and J. Robinson; United States Steel—Gary Works and Reactive Metals & Alloys Corp.—1991 Steelmaking Conference Proceedings No Month.

Improvements in Desulfurization Performance at Weirton Steel by J.G. Pretka and J.L. Blake; Weirton Steel Corporation—Sep. 1995 Iron and Steelmaker.

* cited by examiner

CARRIER MATERIAL AND DESULFURIZATION AGENT FOR DESULFURIZING IRON

FIELD OF THE INVENTION

The present invention relates to a carrier material and a desulfurization agent for use in reducing the sulfur content of molten iron.

BACKGROUND OF THE INVENTION

The presence of sulfur, in most types of steel, above about 0.015% is undesirable. Sulfur is known to cause "hot-shortness" of steel during the hot rolling step of sheet steel processing. The presence of a sulfur containing liquid phase along grain boundaries of the metal causes a weakness of the metal at hot rolling temperatures.

Sulfur is most conveniently removed either 1) from molten iron, for example, after tapping from a blast furnace; or 2) from molten steel, for example, after processing in a BOP (basic oxygen process) vessel. Reducing sulfur content from iron following tapping from a blast furnace is preferred as the presence of carbon with the iron enhances the chemical reaction for removing the sulfur.

The practice of converting molten iron to steel as carried out in a BOP vessel by blowing oxygen into molten iron is known to reduce the sulfur content without additional treatment. That reduction in sulfur however is often not sufficient to meet the specifications of the grade of steel being produced and additional treatment must be carried out on the molten metal.

Various processes are described in U.S. Patents for lowering the sulfur content beyond that possible in a BOP vessel. They are carried out both on molten iron and molten steel.

U.S. Pat. No. 4,853,034 describes a process carried out on steel in a ladle wherein a calcium aluminate slag to which MgO is added is used to lower the sulfur content of the steel.

In U.S. Pat. No. 5,397,379 recycled LMF (ladle metallurgy furnace) slag is used for treating steel in a ladle. It is of a particle size between 1 inch and +20 mesh and is preferably added to the ladle while the steel is being tapped.

U.S. Pat. No. 5,972,072 describes a method of treating liquid iron wherein a desulfurization material is injected using a lance with a carrier gas or is carried out by adding the material as the hot metal is being poured into a ladle. The desulfurization material is made up of 3–20% particulate metallic aluminum, 5–30% alumina, 0.5–12% particulate hydrocarbon material, and the balance lime.

Many of such prior practice methods and materials result in a slag which is heavily laden with droplets of molten iron. Such condition results in a significant loss of iron with slag removal and a decrease in iron yield.

SUMMARY OF THE INVENTION

The present carrier material and desulfurization agent, and preferred process for their use reduces the sulfur content of liquid iron while the iron is contained in a hot metal vessel such as a transfer ladle and forms a slag which is easily skimmed from the molten iron surface and which entraps less iron than prior practice materials.

In a process wherein the carrier material of the invention is used, a lance is provided to direct the flow of a pressurized transport gas to which a particulate high percentage calcium aluminate carrier material is added. The flow of the transport gas and carrier material is initiated in the lance and the lance is then inserted into the molten iron. As the flow continues particulate magnesium (Mg) combined with up to 10% of lime (CaO), referred to herein as passivated magnesium, is added to the flow. The flow continues for a treatment period determined by the initial sulfur content of the iron and the final sulfur content desired. At the conclusion of such treatment period, the passivated magnesium flow is terminated with the gas-carrier material flow continued until the lance is raised above the slag surface. All of the particulate carrier material injected into the iron is of a particle size of about 200 mesh (85% minus 200 mesh and 100% minus 20 mesh). The carrier material is calcium aluminate combined with lime and preferably calcium fluoride and contains, by analysis, from about 54–74% CaO, from about 19–32% $Al_2O_3$, from about 0–4% MgO, and from about 0–10% $CaF_2$ (all percentages being weight %). Impurities often associated with calcium aluminate, which can be detrimental to the desulfurization process, are kept below the following levels: $SiO_2$-2.5% max, $Fe_2O_3$-1.0% max, $P_2O_5$-0.025% max and $TiO_2$-0.025% max MnO-0.5% max, $V_2O_5$-0.025 max, $K_2O$-0.025 max, and S-0.05 max. A combined LOI(loss on ignition)/moisture level of the material is less than 1.5%.

In a process wherein the desulfurization agent of the invention is used, a pre-blended mixture of the above carrier material and selected amounts of passivated magnesium material are delivered in the combined state from a pressurized vessel to the lance for injection.

In a third embodiment of the invention a narrow compositional range of the carrier material is used both before and following known desulfurization treatments to improve slag characteristics and increase iron yield.

Other specific features of the invention are described in more detail in relation to the accompanying drawings.

DETAILED DESCRIPTION OF THE INVENTION

Figure 1:
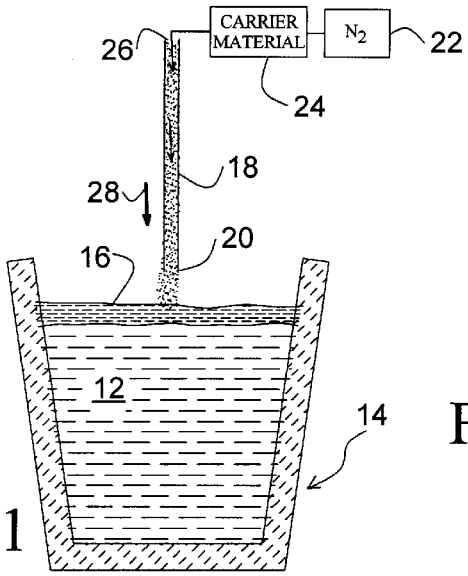
FIG. 1 is a schematic illustration of an initial step for establishing a flow of a transport gas and carrier material of the invention in a lance.

A steelmaking process is briefly described for disclosing the preferred location for a desulfurization process carried out with use of the carrier material, desulfurization agent and slag treatment of the invention. A blast furnace is used to convert iron ore into iron using coke and limestone as the principle components for the conversion. Resultant molten iron is periodically cast from the blast furnace, near its base, and directed to a refractory lined transfer vehicle. Such molten iron can be desulfurized in such vehicle or can be desulfurized after pouring into transfer ladles at a melt shop with use of materials of the invention (described below). In a next step of the steelmaking process the substantially desulfurized iron is transferred to a "BOP" (basic oxygen process) vessel wherein high-pressure oxygen is blown into the molten iron through a water cooled lance to reduce carbon and silicon content of the molten metal. The molten metal is then tapped into a ladle where a variety of processes can be carried out such as adding or removing minor elements, degassing, etc. The molten metal, now referred to as steel, is then cast into ingots or more likely transferred into a tundish for casting into continuous strip or other shapes at a continuous caster.

The steps for carrying out a desulfurization process using a first embodiment of the invention for reducing sulfur content of the iron and producing an improved slag are depicted sequentially in FIGS. 1–5. Molten iron 12 cast from a blast furnace and having a temperature of about 2700° F., when cast, is contained in refractory lined transfer ladle 14. The temperature of the iron in the ladle during desulfurization processing at the steelmaking facility is about 2350–2550° F. A layer of slag 16 covers the molten iron to prevent oxidation of the iron, reduce heat loss, and react with elements in the molten iron. A refractory protected lance 18 is provided for conveying material of the invention into the molten iron. In an initial step (FIG. 1) lance 18 is disposed with its delivery end 20 above slag layer 16. A flow of pressurized nitrogen, other inert gas, or fuel gas 22 and a carrier material of the invention 24 is begun. The nitrogen gas 22 flows into the vessel of carrier material 24 and both are delivered by a suitable means to entry end 26 of the lance. Throughout this disclosure $N_2$ is specified as the transport gas as it is the preferred gas except in cases where very low nitrogen content in the steel is desired. The nitrogen is delivered at a pressure in a range between 100 and 200 psi with a pressure of 120–160 psi preferred.

Carrier material 24 is a particulate material which is a combination of calcium aluminate, lime and calcium fluoride to give a composition as listed in Table I. 85% of the material passes a 200 mesh screen and 100% passes a 20 mesh screen (U.S. seive).

TABLE I

CARRIER MATERIAL

| Compound | Formula | Wt. % |
|---|---|---|
| Calcium Oxide | CaO | 54–74 |
| Aluminum Oxide | $Al_2O_3$ | 19–32 |
| Magnesium Oxide | MgO | 4 max |
| Calcium Fluoride | $CaF_2$ | 10 max |
| Silicon Dioxide | $SiO_2$ | 2.5 max |
| Iron Oxide | $Fe_2O_3$ | 1.0 max |
| Phosphorus Pentoxide | $P_2O_5$ | 0.025 max |
| Titanium Dioxide | $TiO_2$ | 0.025 max |
| Manganese Oxide | MnO | 0.5 max |
| Vanadium Pentoxide | $V_2O_5$ | 0.025 max |
| Potassium Oxide | $K_2O$ | 0.025 max |
| Sulfur | S | 0.05 max |
| Polymethyl Hydro Siloxane | — | 0.01–0.2 |
| Combined LOI/moisture Content | — | 1.5 max |

A preferred composition of the carrier material has a calcium oxide range of 57–67%, an aluminum oxide range of 22–28%, a calcium fluoride range of no more than 8%, and combined LOI/moisture content of no more than 1%.

The carrier material is delivered through the lance at a rate of about 100–230 lb/min and the $N_2$ transport gas is delivered at about 0.3 $Nm^3$/min (10 SCF/min). With such rates the volume of solids in the flow stream is over 70%.

Figure 2:
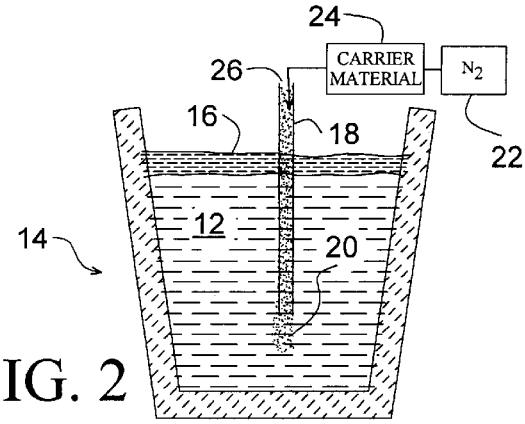
FIG. 2 is a schematic illustration of a lance insertion step wherein the lance is inserted into the molten iron while maintaining the flow of the transport gas and the carrier material.
Figure 3:
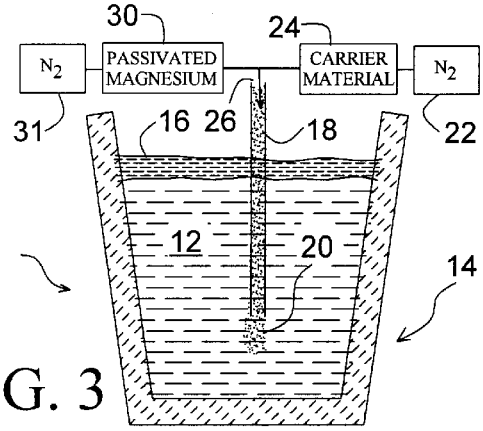
FIG. 3 is a schematic illustration of an intermediate step wherein particulate passivated magnesium is added to the established flow of the transport gas and the carrier material of the invention.
Figure 4:
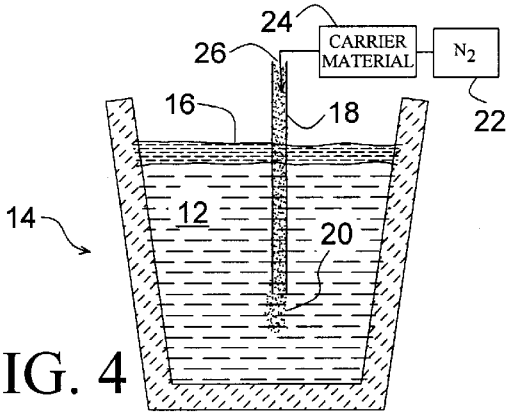
FIG. 4 is a schematic illustration of a step wherein the particulate passivated magnesium flow of FIG. 3 is terminated while the flow of the transport gas and carrier material of the invention is maintained so as to prevent plugging of the lance.

Once the flow of transport gas, $N_2$, and the carrier material is established as depicted in FIG. 1, lance 18 is lowered, as indicated by arrow 28 (FIG. 1) so as to dispose delivery end 20 of lance 18 below the surface of the molten iron as indicated in FIG. 2. The flow as established and described with reference to FIG. 1 is maintained. Next, a particulate mixture 30 of about 90% magnesium (Mg) and about 10% lime (CaO), referred to as passivated magnesium with a magnesium particle size of about 12–20 mesh (U.S. Sieve) is introduced into the flow stream (FIG. 3). The small percentage of lime is combined with the particulate magnesium to reduce hazards associated with particulate magnesium. Such hazards are particularly dangerous during shipment thus making "on-site" preparation of the particulate magnesium the preferred procedure. The passivated magnesium 30 is contained in a separate vessel pressurized by nitrogen 31 and is introduced through the lance at a rate of about 20 to 60 lb/min. The ratio of carrier material to passivated magnesium flowing through the lance and into the molten iron is in the range of 2.5–6:1 and the ratio is often dictated by environmental constraints. The pressure of the $N_2$ transport gas is adjusted, within the range indicated above, to obtain optimum flow rates of all the materials through the lance. The delivery end 20 of lance 18 is below the molten iron surface a distance of about 2.5 to 4 meters and the injected particulate material provides a stirring action to the ladle contents. This combination of carrier material (Table I) and passivated magnesium is referred to herein as the desulfurization agent. It is important that a combined LOI/moisture content of the carrier material is less than 1.5%, and preferably less than 1%, so as not to cause severe ladle turbulence or increased oxygen content of the iron. The presence of oxygen decreases the chemical efficiency of the magnesium which is the predominant component for sulfur removal. Although severe turbulence is not desired, a moderate amount of turbulence is beneficial to the process. Such can be provided, as is well known in the art, by adding up to about 2% of a hydrocarbon material such as rubber shavings, coal powder, or particulate plastic to the above described material flow. Such materials generate a stirring gas is which non-desirable oxygen is not present.

Particle size of the carrier material (about 200 mesh) and the passivated magnesium (about 12–20 mesh) is an important characteristic of the material of the invention and will:

a) produce a more homogenous mixture of material being injected,
b) improve desulfurization agent flowability,
c) reduce desulfurization agent surging during injections,
d) reduce molten iron splashing related to surging,
e) reduce environmental issues from molten iron splashing, and
f) reduce the iron yield reduction related to splashing of molten iron.

The injection of the passivated magnesium continues for a predetermined period of time which is dependent on the initial content of sulfur in the iron and the desired finish content of sulfur in the iron. Desulfurization formulas are used to determine the total amount of Mg required for specific steel grades. Such an amount for injection can be expressed in lb of Mg/ton of iron.

Figure 5:
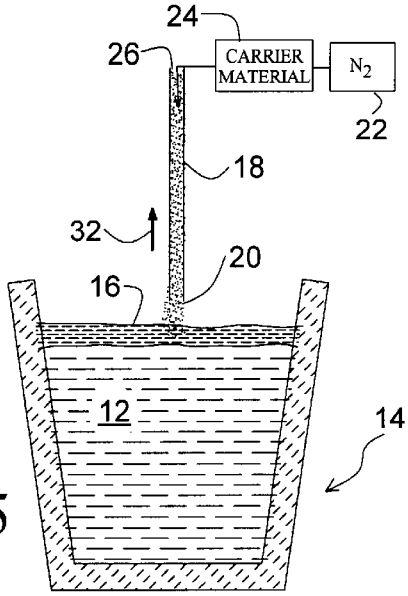
FIG. 5 is a schematic illustration of a final step wherein the lance is retracted from the molten iron while maintaining the flow of the transport gas and the carrier material of the invention.

Following injection of the predetermined quantity of Mg, the introduction of passivated magnesium into the flow stream is terminated (FIG. 5). To prevent plugging of the lance with iron or slag material, the flow of nitrogen 22 and carrier material 24 is continued while the lance is retracted in the direction of arrow 32 to position exit end 20 of lance 18 above the top surface of the slag.

During the desulfurization process, the depth of the slag cover above the molten iron increases as the injected material rises to the surface to form a slag of high basicity. Compounds of magnesium and sulfur as well as other elements are soluble in the slag and form a part of the increased slag cover.

The presence of calcium aluminate and/or $CaF_2$ in carrier material 24 of the invention decreases the viscosity of the formed slag, reduces the time required for skimming the slag from the surface of the iron, and also reduces splashing of slag and iron during such skimming. The turbulent mixing of the iron and desulfurization material during injection causes entrapment of molten iron in the slag. Such decreased viscosity results in less molten iron droplets being entrapped and retained in the slag. Tests conducted in a steelmaking facility over a period of two weeks used the preferred material (B) of the invention and the process described above in 132 heats, and used substantially a lime slag material (A) in 426 heats to compare the amount of slag and ease of removing the slag. The following data were obtained:

| | (A) Lime | (B) Material of the Invention |
|---|---|---|
| Average lbs. of skimmed slag material: | 12602 | 8424 |
| Average Time required to skim: | 9.3 min. | 6.1 min. |

A 34.4% reduction in time required for skimming was realized and it was found that the slag formed with use of the desulfurization material of the invention was lighter and dryer, retained less iron than prior practice slags and thus increased the iron yield. The decrease in time required for skimming results in less heat loss from the molten iron thus the temperature of the molten iron is maintained higher. All such factors add to the productivity of the steelmaking facility.

Figure 6:
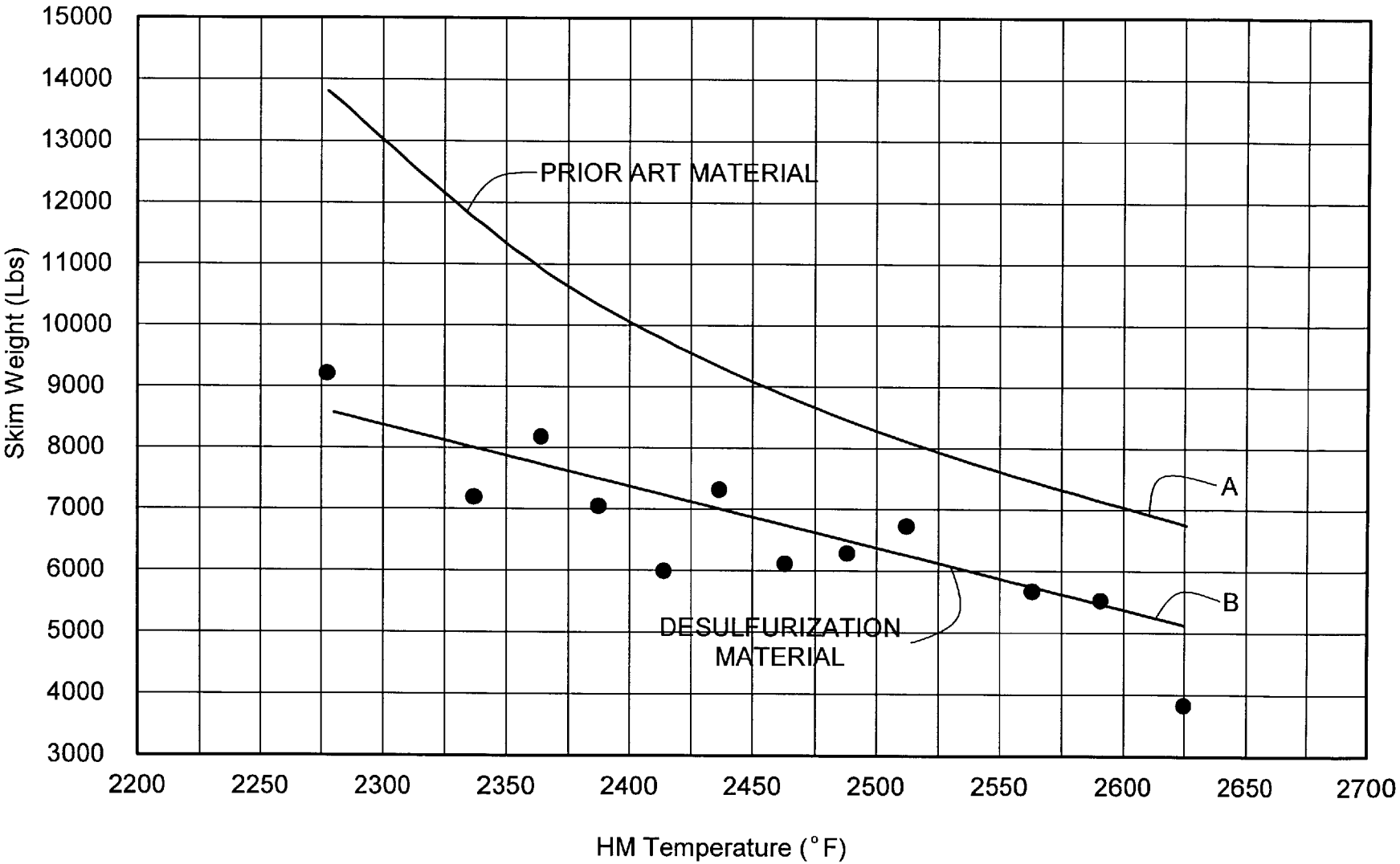
FIG. 6 is a graphic representation of slag skim weight vs hot metal temperature with use of desulfurization material of the invention.

FIG. 6 shows graphically the results of other tests comparing skim weight of slag vs hot metal temperature for A) prior art desulfurization material and B) desulfurization material of the invention. At all temperatures of processing the skim weight of slag using the desulfurization material of the invention is less than with use of prior art material. Such difference is primarily due to the reduction in the amount of entrapped droplets of molten iron in the slag.

The desulfurization agent of the invention, having a fine particle size, combined with the preferred method of use, described above, enables higher injection rates compared with prior art processes and results in a desulfurization treatment for iron which is less time consuming than prior methods and compositions, and which utilizes the reacting elements in a most efficient manner. Because of the small particle size of the desulfurization material, substantially all the material is utilized, in contrast with larger sized material (such as in U.S. Pat. No. 5,397,379 described above), wherein penetration and diffusion through an outer surface layer of the larger sized material increases reaction time. The deep lance injection and stirring action resulting from the force of the injection, along with the fine particle size and the high percentage of solids, provide a very active, homogenous environment for the desulfurization chemical reactions to take place.

Following desulfurization, the molten iron contained in the ladle is preferably transferred to a BOP vessel for further processing as described above.

The carrier material of the invention can be prepared by combining four commercially available components: 1) pulverized lime (CaO), 2) calcium aluminate, which, for example, is available commercially as "Kwikflux 50" from AlumiCa Inc.; 3) metallurgical grade calcium fluoride (Fluorspar) available commercially; and 4) a siloxane material added at a rate of about 0.01–0.2% by wt. of the total carrier material, for example, a material that is available commercially as "Flow Aid" from T. G. Chemical Co., Pittsburgh, Pa. which is blended uniformly with the other components to improve flow characteristics. Such flow aids are a polymethyl hydro siloxane material well known in the art.

A carrier material can, for example, be prepared by mixing together about 44% quicklime, about 50% "Kwikflux 50" (calcium aluminate), about 6% $CaF_2$ and about 0.125% "Flow Aid". The four components of the carrier material, if not of a particle size of about 200 mesh as supplied, are reduced to such size and are blended together.

Figure 7:
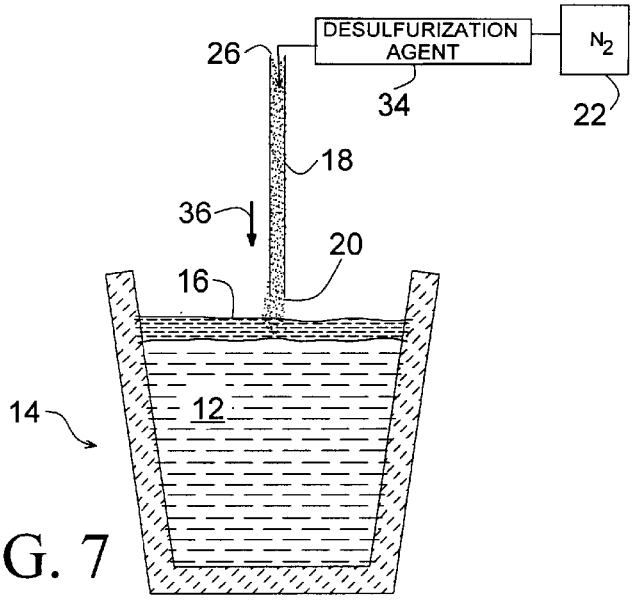
FIG. 7 is a schematic illustration of an initial step of a second embodiment wherein the carrier material and particulate passivated lime are pre-blended to form a desulfurization agent of the invention and flow of the desulfurization agent and a transport gas is established in a lance.
Figure 8:
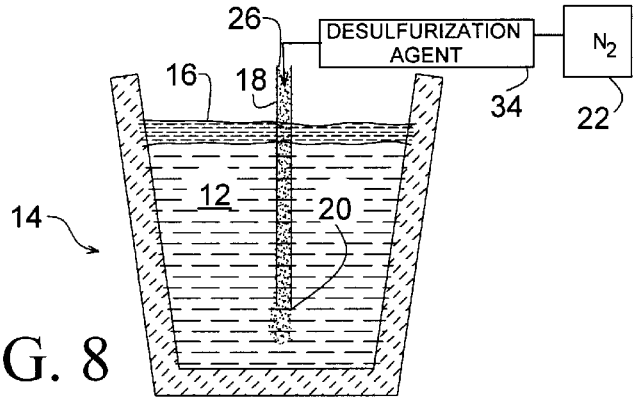
FIG. 8 is a schematic illustration of an intermediate step of the second embodiment wherein the desulfurization agent of the invention is injected through the submerged lance into the iron.
Figure 9:
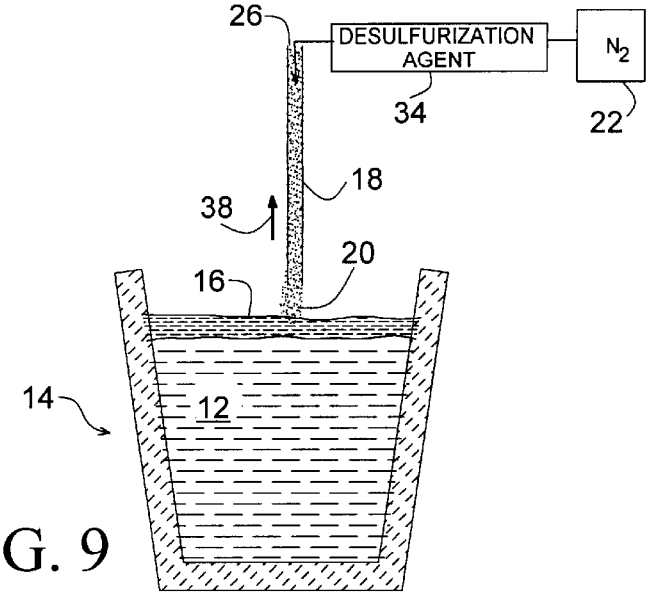
FIG. 9 is a schematic illustration of a final step of the second embodiment wherein the flow of desulfurization agent of the invention and the transport gas is maintained in the lance as it is retracted from the molten iron so as to prevent plugging of the lance.

A second composition of matter of the invention and a preferred method for its use are described with reference to FIGS. 7–9. In such embodiment, the carrier material and the passivated magnesium, both described in relation to the first embodiment above, are pre-blended at a carrier material: magnesium ratio of 2–6:1 and held in a single pressurized vessel prior to introduction for flow through the lance. Such combination, indicated at 34, is referred to herein as the desulfurization agent of the invention. It is introduced by the flow of pressurized transport gas nitrogen 22 into its containment vessel to provide for flow through lance 18 as depicted in the schematic illustration of FIG. 7. Flow of nitrogen and desulfurization agent 34 is established in lance 18 with exit end 20 of the lance disposed above the top surface of slag layer 16. Once the flow is established, the lance is lowered as indicated by arrow 36 so as to dispose lance exit end 20 below the top surface of the molten iron as depicted in FIG. 8. Flow of the desulfurization agent and transport gas $N_2$ is continued for a predetermined period of time based on the initial sulfur content of the iron and the desired sulfur content for the iron. Such time is determined using formulas for specific steel grades as discussed above. At the end of the predetermined period the lance is retracted as indicated by arrow 38 (FIG. 9) while the flow of desulfurization agent and transport gas $N_2$ continues so as to prevent clogging of the lance with slag and iron. Following retraction of the lance to above the layer of slag the flow of desulfurization agent and $N_2$ is terminated. The advantages of such desulfurization agent for reducing sulfur content in molten iron are as described above in relation to the first embodiment. The particle size of the components of such desulfurization agent is about 200 mesh (100% minus 20 mesh, 85% minus 200 mesh) with the exception of Mg which has a particle size between about 12–20 mesh (both U.S. seive). The composition of such desulfurization agent is tabulated in Table II below.

TABLE II

DESULFURIZATION AGENT

| Compound | Formula | Wt. % |
|---|---|---|
| Calcium Oxide | CaO | 42–65 |
| Aluminum Oxide | $Al_2O_3$ | 14–28 |
| Magnesium | Mg | 23–33 |
| Magnesium Oxide | MgO | 3.5 max |
| Calcium Fluoride | $CaF_2$ | 8.5 max |
| Silicon Dioxide | $SiO_2$ | 2.2 max |
| Iron Oxide | $Fe_2O_3$ | 0.9 max |
| Phosphorus Pentoxide | $P_2O_5$ | 0.022 max |
| Titanium Dioxide | $TiO_2$ | 0.022 max |
| Manganese Oxide | MnO | 0.43 max |
| Vanadium Pentoxide | $V_2O_5$ | 0.022 max |
| Potassium Oxide | $K_2O$ | 0.022 max |
| Sulfur | S | 0.043 max |
| Polymethyl Hydro Siloxane | — | 0.01–0.2 |
| Combined LOI/moisture Content | — | 1.5 max |

A preferred composition of the desulfurization agent has a calcium oxide range of 49–55%, an aluminum oxide range of 19–22%, a calcium fluoride range of no more than 7%, a magnesium range of 23–33% and combined LOI/moisture content of no more than 1%.

The desulfurization agent can, for example, be prepared by blending passivated magnesium with carrier material made from quicklime, Kwikflux 50, $CaF_2$, and "Flow Aid" as indicated above.

Desulfurization results and iron yield improvement obtained by using the first embodiment or the second embodiment are substantially the same. The choice of process and material used can be made by analyzing existing practices in use with prior-art desulfurization materials at the particular steelmaking facility, and evaluating existing equipment which might be adaptable for use with the present materials. The first embodiment can provide more flexibility for varying the ratio of Mg to the carrier material. The second embodiment wherein passivated magnesium is preblended with the carrier enables a higher percentage of Mg in the desulfurization agent compared with the co-injecting method used with the first embodiment.

A third embodiment for improving characteristics of slag during desulfurization so as to improve iron yield is also available as a material of the invention. Such embodiment referred to herein as a slag treatment of the invention can be used with existing magnesium containing desulfurization material and practice of a steelmaking facility. The preferred practice for use of the slag treatment is to inject into the molten iron about 50–100 pounds of the slag treatment prior to injecting the magnesium containing desulfurization material being used. Then, following completion of injecting that desulfurization material, injecting about 300–500 pounds of the slag treatment material. Such practice results in a slag having the lighter and dryer consistency described above which leads to an increase in iron yield. The preferred composition for the slag treatment is within the ranges of the carrier material of Table I. However, in a preferred embodiment calcium oxide is preferable at the low end of the range (about 54%) and aluminum oxide is preferably at the high end of the range (about 32%). Such slag treatment can, for example, be prepared by combining about 34% quicklime, about 60% Kwikflux 50, about 6% $CaF_2$ and about 0.12% "Flow Aid".

Figure 10:
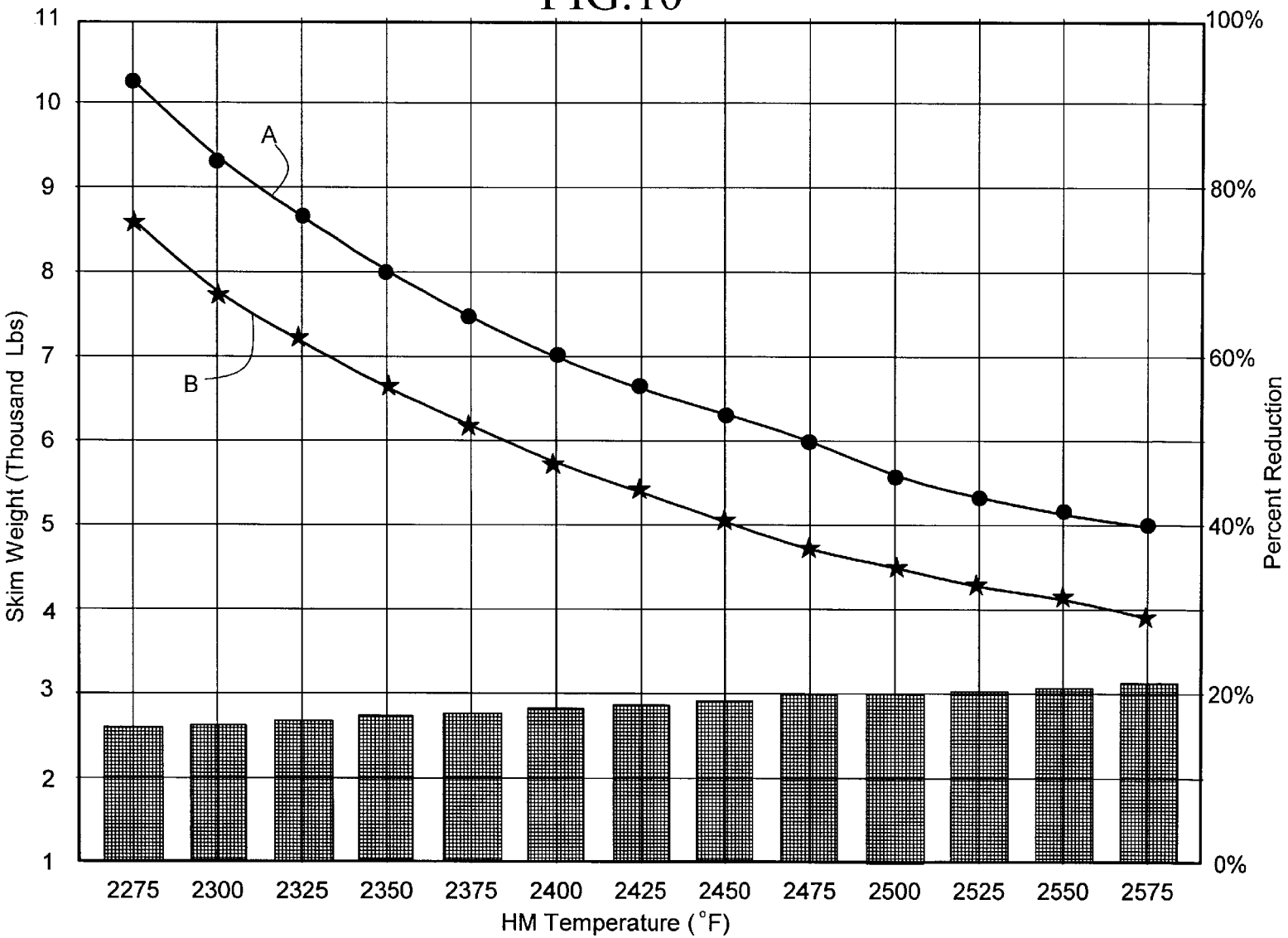
FIG. 10 is a graphic representation of slag skim weight and % reduction in slag skim weight vs hot metal temperature with use of slag treatment of the invention.

FIG. 10 shows graphically the results of tests carried out to measure the reduction in slag weight when using the slag treatment of the invention. Curve "A" depicts slag weight with use of prior practice materials vs processing temperature, while curve "B" depicts slag weight with use of slag treatment of the invention, vs processing temperature. At all processing temperatures the amount of slag is less with use of the slag treatment of the invention, compared with prior practice.

The bar graph of the figure indicates the reduction in slag, and it is expressed in % which is indicated along the right vertical axis of the graph. Reductions of about 20% have been realized.

While specific materials, composition ranges and processing steps have been set forth for purposes of describing embodiments of the invention, various modifications can be resorted to, in light of the above teachings, without departing from Applicants' novel contribution; therefore in determining the scope of the present invention reference shall be made to the appended claims.

What is claimed is:

1. A particulate carrier material, for the introduction of magnesium metal combined with 0–10% lime into molten iron so as to desulfurize the iron, comprising calcium aluminate combined with lime and calcium fluoride to give a composition having, in percentages by weight:

54–74% calcium oxide, 19–32% aluminum oxide, no more than 4% magnesium oxide, no more than 10% calcium fluoride, no more than 2.5% silicon dioxide, no more than 1.0% iron oxide, no more than 0.025% phosphorus pentoxide, no more than 0.025% titanium dioxide, no more than 0.5% manganese oxide, no more than 0.025% vanadium pentoxide, no more than 0.025% potassium oxide, no more than 0.05% sulfur and a combined loss on ignition and moisture content of no more than 1.5%, the particulate carrier material having a particle size of about 200 mesh.

2. A particulate carrier material as defined in claim 1, wherein the calcium oxide is present in an amount of 57–67%.

3. A particulate carrier material as defined in claim 1, wherein the aluminum oxide is present in an amount of 22–28%.

4. A particulate carrier material as defined in claim 1, wherein calcium oxide is present in an amount of 57–67%, aluminum oxide is present in an amount of 22–28%, and calcium fluoride is present in an amount of no more than 8%.

5. A particulate carrier material, for the introduction of magnesium metal combined with 0–10% lime into molten iron so as to desulfurize the iron, comprising calcium aluminate combined with lime and calcium fluoride to give a composition having, in percentages by weight:

57–67% calcium oxide, 22–28% aluminum oxide, no more than 4% magnesium oxide, no more than 8% calcium fluoride, no more than 2.5% silicon dioxide, no more than 1.0% iron oxide, no more than 0.025% phosphorus pentoxide, no more than 0.025% titanium dioxide, no more than 0.5% manganese oxide, no more than 0.025% vanadium pentoxide, no more than 0.025% potassium oxide, no more than 0.05% sulfur and a combined loss on ignition and moisture content of no more than 1.0%, the particulate carrier material having a particle size of about 200 mesh.

6. A particulate carrier material, as defined in claim 1, further comprising polymethyl hydro siloxanes in an amount of 0.01–0.2%.

7. A particulate desulfurization agent, for introduction into molten iron so as to desulfurize the iron, comprising, in percentages by weight:

calcium aluminate combined with lime and calcium fluoride to give a composition having 54–74% calcium oxide, 19–32% aluminum oxide, no more than 4% magnesium oxide, no more than 10% calcium fluoride, no more than 2.5% silicon dioxide, no more than 1.0% iron oxide, no more than 0.025% phosphorus pentoxide, no more than 0.025% titanium dioxide, no more than 0.5% manganese oxide, no more than 0.025% vanadium pentoxide, no more than 0.025% potassium oxide, and no more than 0.05% sulfur, having a particle size of about 200 mesh;

combined at a ratio in the range of 2–6 parts with 1 part of

90–100% Mg and 0–10% CaO, having a particle size in the range of 14–20 mesh, said agent having a combined loss on ignition and moisture content of no more than 1.5%.

8. A particulate desulfurization agent as defined in claim 7, wherein calcium oxide is present in an amount of 49–55%.

9. A particulate desulfurization agent as defined in claim 7, wherein aluminum oxide is present in an amount of 19–22%.

10. A particulate desulfurization agent as defined in claim 7, wherein calcium oxide is present in an amount of 49–55%, aluminum oxide is present in an amount of 19–22%, and calcium fluoride is present in an amount of no more than 8%.

11. A particulate desulfurization agent as defined in claim 7, further comprising polymethyl hydro siloxanes in an amount of 0.07–0.12%.

12. A particulate desulfurization agent for introduction into molten iron so as to desulfurizing the iron comprising calcium aluminate combined with lime, calcium fluoride and magnesium to give a composition having, in percentages by weight:

23–33% magnesium, 42–65% calcium oxide, 14–28% aluminum oxide, no more than 3.5% magnesium oxide, no more than 8.5% calcium fluoride, no more than 2.2% silicon dioxide, no more than 0.9% iron oxide, no more than 0.022% phosphorus pentoxide, no more than 0.022% titanium dioxide, no more than 0.43% manganese oxide, no more than 0.022% vanadium pentoxide, no more than 0.022% potassium oxide, no more than 0.043% sulfur, the particulate magnesium having a particle size of between about 14 and 20 mesh, the remaining particulate components having a particle size of about 200 mesh said agent having a combined loss on ignition and moisture content of no more than 1.5%.

13. A particulate desulfurization agent as defined in claim 12, wherein said agent has a combined loss on ignition and moisture content of no more than 1%.

14. A particulate desulfurization agent as defined in claim 12, further comprising polymethyl hydro siloxanes in an amount of 0.07–0.12%.

15. A particulate slag forming material, for conditioning slag during a process to desulfurize iron, comprising calcium aluminate combined with lime to give a composition having, in percentages by weight:

about 54% calcium oxide, about 32% aluminum oxide, no more than 4% magnesium oxide, no more than 10% calcium fluoride, no more than 2.5% silicon dioxide, no more than 1.0% iron oxide, no more than 0.025% phosphorus pentoxide, no more than 0.025% titanium dioxide, no more than 0.5% manganese oxide, no more than 0.025% vanadium pentoxide, no more than 0.025% potassium oxide, no more than 0.05% sulfur and a combined loss on ignition and moisture content of no more than 1.5%, the particulate carrier material having a particle size of about 200 mesh.

16. A particulate slag forming material as defined in claim 15, further comprising polymethyl hydro siloxanes in an amount of 0.01–0.2%.

* * * * *